United States Patent [19]

Boser et al.

[11] 4,030,429

[45] June 21, 1977

[54] SEWING MACHINE ATTACHMENT

[75] Inventors: Ronald J. Boser, Dix Hills, N.Y.; Walter P. Siegel, Lebanon, N.J.

[73] Assignee: Special Sewing Systems, Inc., New York, N.Y.

[22] Filed: Aug. 18, 1976

[21] Appl. No.: 715,350

[52] U.S. Cl. ..... 112/104; 112/152; 270/61 R

[51] Int. Cl.[2] ..... D05B 3/12

[58] Field of Search ..... 112/104, 113, 115, 88, 112/130, 2, 99, 152, 203; 156/521, 538, 556; 270/78, 61 R

[56] References Cited

UNITED STATES PATENTS

| | | | |
|---|---|---|---|
| 1,642,386 | 9/1927 | Reis et al. | 112/104 |
| 3,244,343 | 4/1966 | Martin | 112/104 X |
| 3,699,907 | 10/1972 | Anderson et al. | 112/104 X |
| 3,766,870 | 10/1973 | Weigert | 112/104 |
| 3,812,800 | 5/1974 | Ziegler et al. | 112/104 |

FOREIGN PATENTS OR APPLICATIONS

| | | | |
|---|---|---|---|
| 846,616 | 7/1970 | Canada | 112/104 |

*Primary Examiner*—H. Hampton Hunter
*Attorney, Agent, or Firm*—John W. Harbst; John A. Schaerli

[57] ABSTRACT

A sewing machine attachment for inserting a preselected size label to the underside of the garment which is to be sewn. A predetermined length of ribbon is cut from a label storage area, engaged and folded upon itself by an inserter band which advances the label to a transporter assembly. The label is presented above the feed dog and below the material by the transporter assembly, which maintains a parallel relationship with the work support of the machine during its path of movement, whereby insuring accurate delivery of the label into close proximity with the sewing area. The label is removed from the transporter by the feed mechanism, which advances the label, along with the garment to be sewn, to the sewing area. A pneumatic control system sequences the label insertion operation.

25 Claims, 16 Drawing Figures

142
144
149
65
61
66
46
92
120
62
136
98
66b
140
132
134
138
128
131
66a
135
129
140
124
122
150
18
10
28
92
95
94
46
58
60
148
146
142
20
149
144
11
11
114
24
140
22
26
442
150
136
120
126
290
284
287
330
334
322
328
336
332
318
320
335
326
327
384
324
382
33
380
318
412
414
312a
310a
309
306
314
308
410
304
307

FIG-3
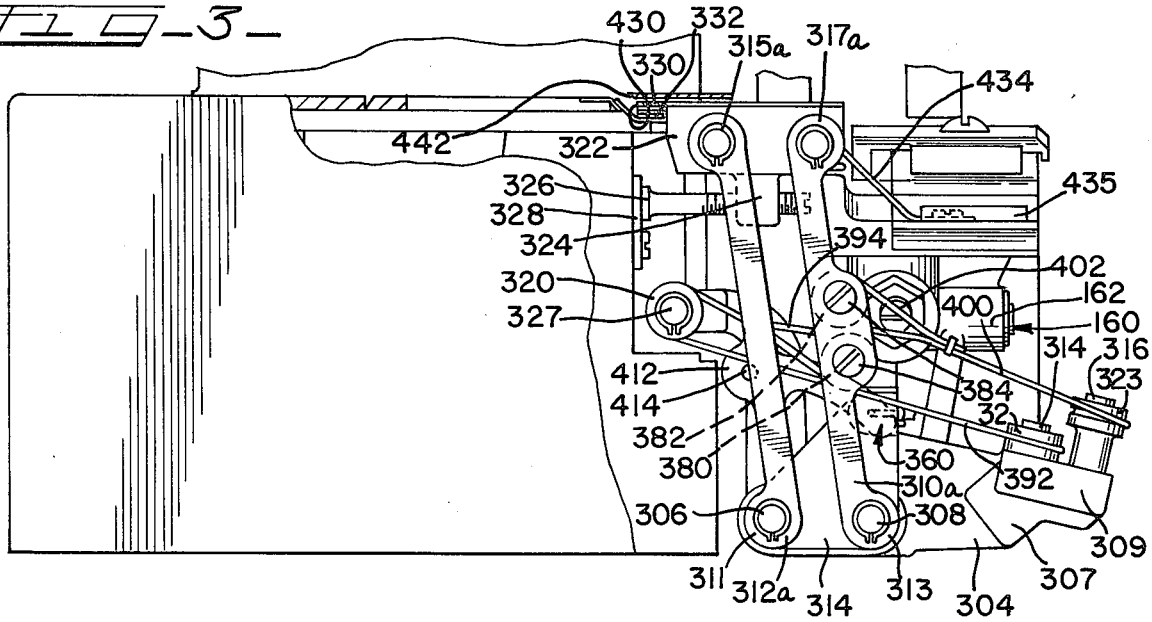
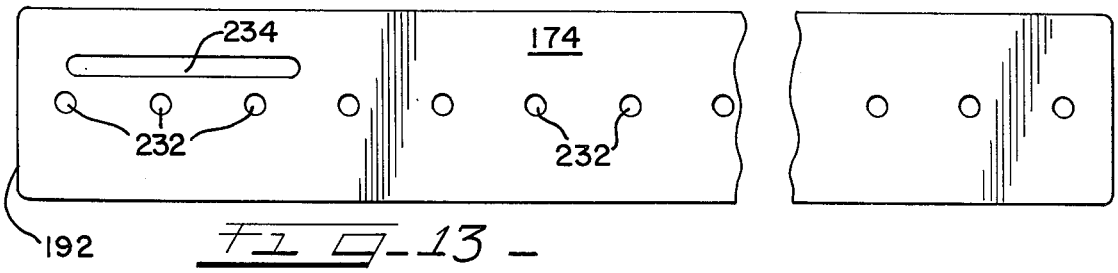
FIG-13
FIG-14
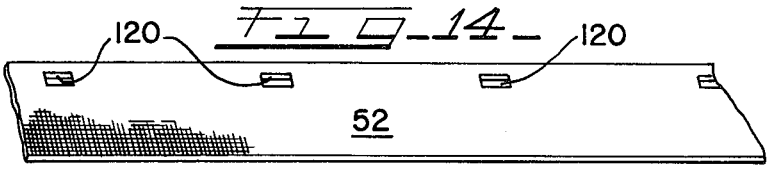
FIG-12
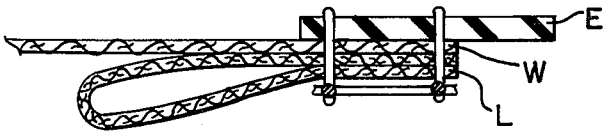
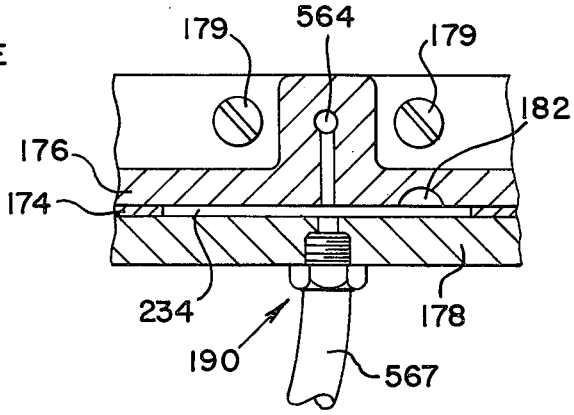
FIG-6
FIG-15
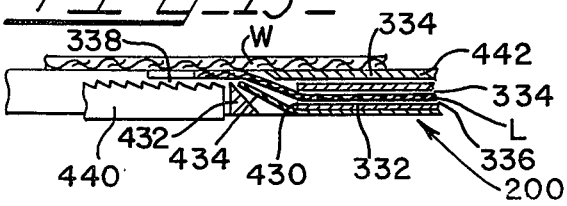

FIG. 7
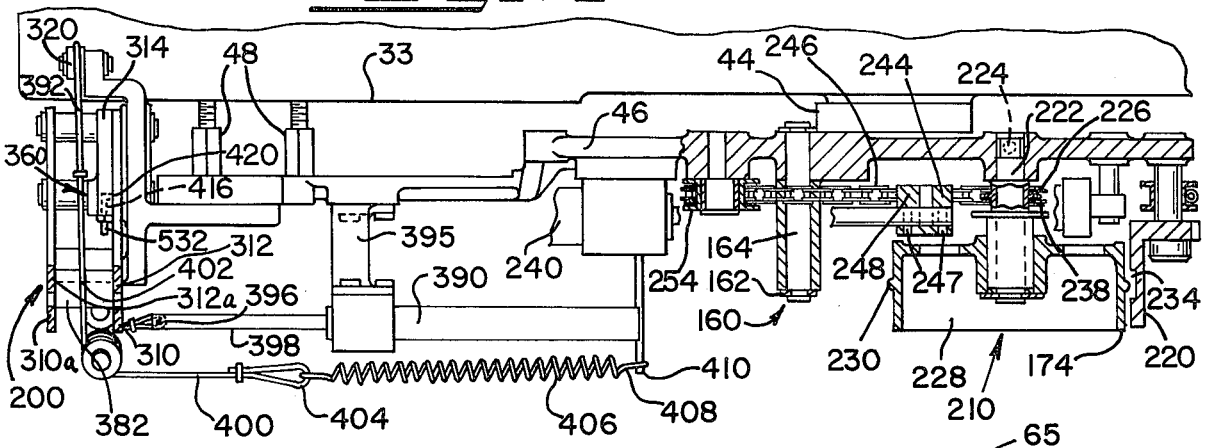
FIG. 9
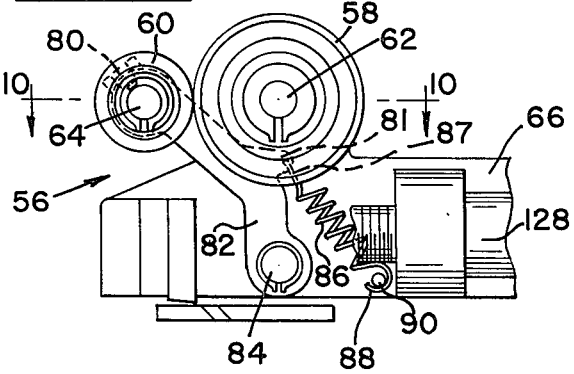
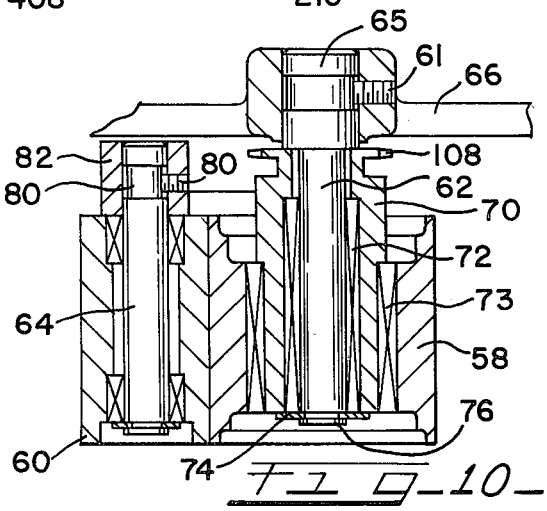
FIG. 10
FIG. 11
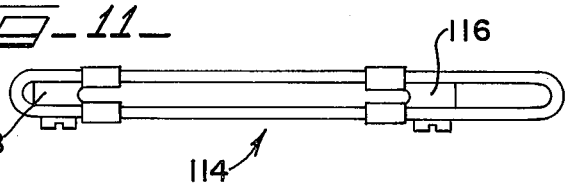
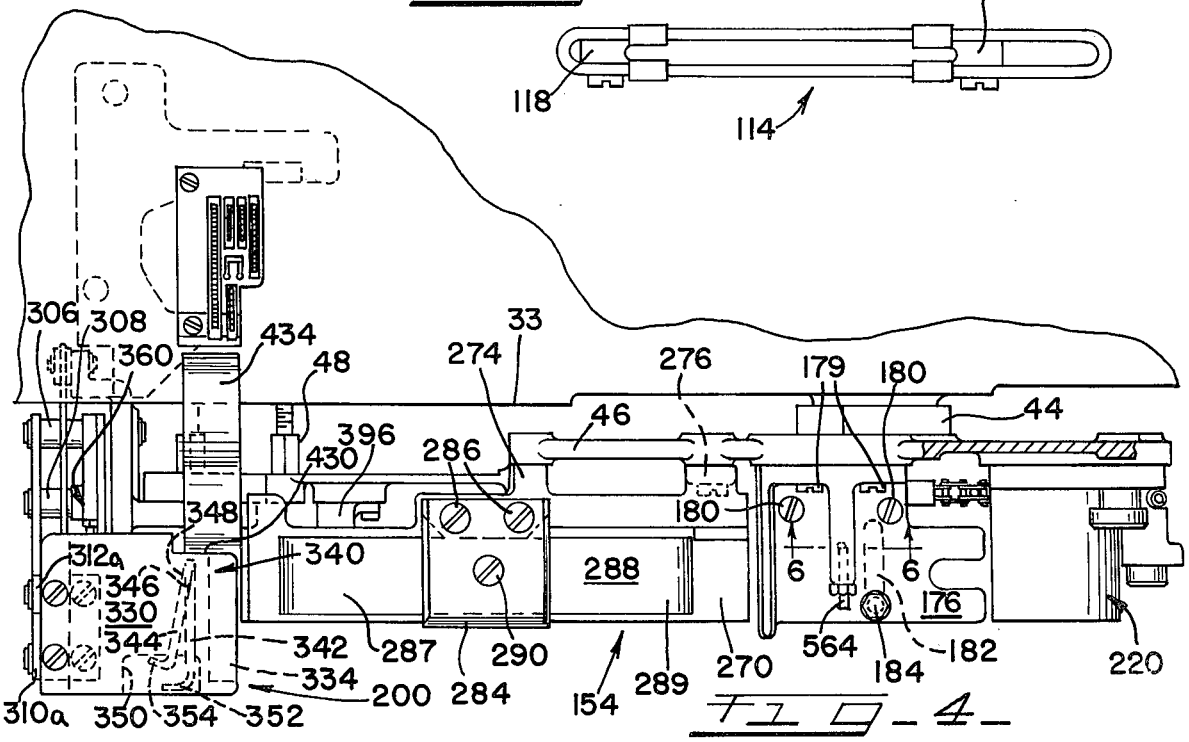
FIG. 4

SEWING MACHINE ATTACHMENT

The present invention relates generally to an attachment for sewing machines, and more particularly to an attachment which will take printed labels from a roll, cut preselected lengths of label, fold double, and automatically insert the folded label to the underside of a garment without necessitating stoppage of the sewing operation.

BACKGROUND OF THE INVENTION

In the garment industry a very large percentage of labels are supplied from a roll. Only some exclusive manufacturers of high priced garments use individual woven labels. Therefore, it is necessary for the operator to manually cut each label and place the same into the sewing machine. In sewing a garment, when the operator reaches a point where a label is to be inserted the sewing machine is usually stopped. The operator then retrieves a label from the roll, the label is manually folded and positioned on the premarked spot on the garment and only then can the operator once again commence sewing. The operation of manually feeding a label and the garment into the machine at the same time is difficult to master and therefore requires the employment of a skilled sewing machine operator. Even though the skill of an experienced operator may be employed, the time factor is obviously working against the manufacturer.

DESCRIPTION OF PRIOR ART

Because of all the above stated reasons, many manufacturers have attempted to employ numerous devices for precutting and inserting labels into the hems of garments. These label insertion methods are usually left to the skilled operators and therefore are costly operations. It is already known in the patent literature, as for example in U.S. Pat. No. 3,766,870, how to feed a folded label into the hem during the sewing operation. Generally, a label is cut from a roll, folded and moved into position between the elastic and the top of the fabric. It has been desired in some operations, such as men's briefs and ladies' panties to structure the garment so that the elastic is on the top, then the cloth, and the label on the bottom. Because of the construction of the above identified device it could not lend itself to such an application. The above stated patent has other drawbacks in the fact that the entire label inserting unit mounts above the work surface largely to the right of the operator. By positioning the label inserter above the work surface this in turn places the mass of the device relatively high compared with the lower mass of the machine itself. This results in an undesirable condition because of vibration. By placing the insertion unit on the top of the table the operator's accessibility to the sewing area of the machine is hindered. With the embodiment shown in said patent, the label holding arm passes through the line of sight of the operator and stops to the left of the needle. This means that during the sewing operation the operator must avoid the clamp arm upon both its initial and return movements. This represents a hazard to the operator whose hands are normally guiding the garment in this area. It also represents a distraction within the line of sight as the clamp arm passes twice per garment through the operator's field of vision.

SUMMARY OF INVENTION

Broadly stated, it is an object of this invention to provide a sewing machine attachment which will automatically cut a label from the label ribbon, fold the label and advance the same into close proximity with the stitch forming instrumentalities.

It is a further object of this invention to provide an automatic sewing machine attachment which is compact and located beneath the operator's working area, therefore leaving easy and broad access to the sewing area.

It is yet another object of this invention to provide an attachment which will allow insertion of a label into a hem without obstructing the view of the operator.

It is a further object of this invention to provide an automatic sewing machine attachment which will allow unskilled operators to perform the operation.

It is yet another object of this invention to provide an attachment which automatically positions a label to the underside of a garment which is to be sewn.

It is still a further object of this invention to provide a label feeding and cutting attachment for sewing machines which will perform the operation of selecting a predetermined length of label from a supply roll and sew it into the hem of a garment without necessitating the stoppage of the sewing operation.

It is still a further object of this invention to provide a labelling attachment for sewing machines in which the insertion of the label is controlled by pneumatics.

A sewing machine label inserter attachment demonstrating the objects and advantages of the present invention includes a continuous ribbon supply roll for supplying a ribbon having a plurality of notched areas which are positioned a predetermined distance from each end of a block of printed indicia. These notched areas define the preselected length of the label which is to be cut. As the ribbon is removed from the supply roll the notched area will be detected by a sensor whereby the feed means, drawing the label from the supply roll, will be halted. Simultaneously with the halting of the feed means, the ribbon is clamped at its loose end and a cutter severs a preselected length of label from the ribbon. The label is now folded in half by an inserter band operatively effective to move from a home position and travel along a label feed path. The inserter band is actuated through a second sensor which is operated by a transporter assembly being in the first of two positions. After the label has been fed into the transporter assembly by the inserter band, the transporter is operated through a manually actuated actuated switch by the operator. The transporter assembly then moves the label from the first position, remote from the sewing area, to a position within close proximity of the sewing area, above the feed dog but yet under the material. Movement of the transporter assembly to the sewing area occurs while continuing with the sewing operation, whereby no time is lost inserting the label. The label is removed from the transporter assembly and delivered to the sewing area by the feed dog where it is sewn to the material. A third sensor detects the absence of the label in the transporter and triggers a means to return the transporter assembly to its first position. In the interim the inserter band has returned to its home position. The home position of the inserter band is sensed by a fourth sensor means. The return of the inserter band occurs immediately after it has delivered the fold label into the transporter assembly. After the inserter band has returned to its original position, the ribbon from the supply roll is again fed to the cutting position and a new label is clamped, cut and ready for folding and feeding to the transporter assembly. As stated above, the pneumatic circuitry senses the absence of the label in the transporter assembly and returns the transporter assembly to its first position where it is in position to be loaded. In its first position the transporter assembly once again associates with the second sensor which in turn signals the pneumatic circuitry to forcibly drive the inserter band to again fold and feed a label to the transporter assembly. Here again, no time is lost during the sewing operation due to feeding and loading of the label into the transporter assembly.

The above brief description, as well as further objects, features and advantages of the present invention will be more fully appreciated by reference to the following detailed description of a presently preferred, but none the less illustrated embodiment in accordance with the present invention, when taken in conjunction with the accompanying drawings, wherein:

FIG. 3 is an end elevational view, partially taken in sections, showing the label inserting in its second position;

FIG. 4 is a top plan view along line 4—4 of FIG. 1 showing the sewing area of the machine and the label attachment;

FIG. 6 is a partial sectional view taken along line 6—6 of FIG. 4;

FIG. 7 is a top sectional view taken along line 7—7 of FIG. 1;

FIG. 9 is a partial front elevational view showing the feed assembly;

FIG. 10 is a top view taken along line 10—10 of FIG. 9;

FIG. 11 is a top view of the bracket assembly used for guiding the label to the label cutter;

FIG. 12 is a schematic representation of the seam produced with the label inserted therein;

FIG. 13 is a top view of the inserter band means;

FIG. 14 is a perspective view of a fragment of a label ribbon;

FIG. 15 is a sectional view showing the relative position of the label and inserter during its load position;

Figures 1, 5:
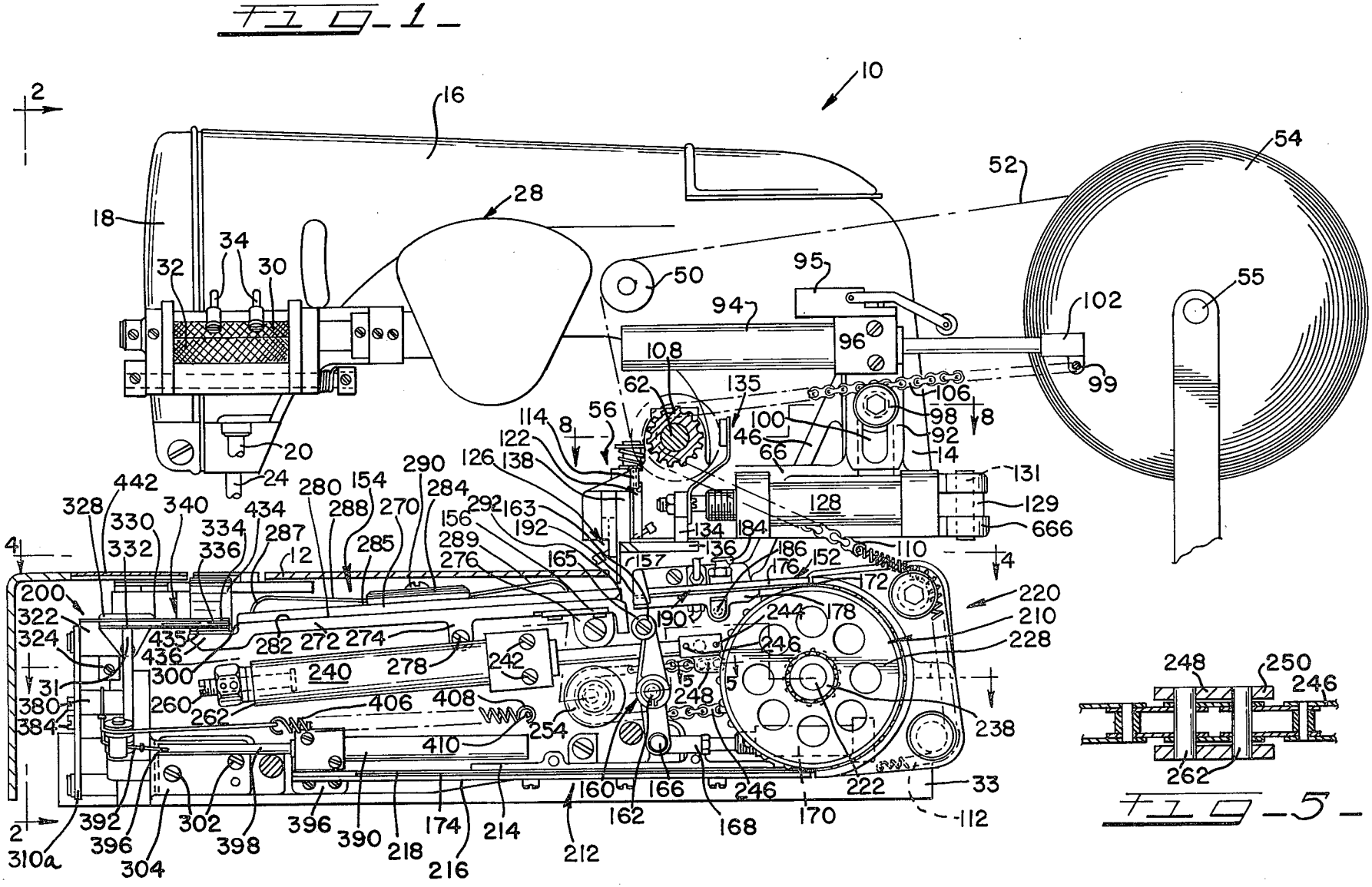
FIG. 1 is a front elevational view of the attachment of the present invention and the sewing machine used in conjunction with the attachment wherein the attachment is shown in its load position.
FIG. 5 is a top plan view taken along line 5—5 of FIG. 1.

FIF. 16 is a schematic diagram of the pneumatic circuitry associated with the label inserter attachment.

DESCRIPTION OF THE PREFFERED EMBODIMENT

In the drawings, wherein like numerals designate like parts, the invention has been shown, for purposes of illustration, as applied to a flatbed sewing machine of the general character disclosed in the U.S. Patent to Reimer No. 2,901,991 granted Sept. 1, 1959. It should be appreciated that the label insertion apparatus disclosed in the present application is not only applicable to flatbed sewing machines but with minor changes may be likely applied to an overedge sewing machine for use in attaching labels to garments. As illustrated, the label insertion apparatus forms a compact mechanical unit which may be mounted directly on the sewing machine so that a label will be presented to the sewing station from the underside thereof whereby the operator's working area will not be obstructed. The pneumatic control, to be described, housing the required circuitry and air valves, is mounted under the sewing machine table to further avoid obstructing the work area.

Figures 2, 8:
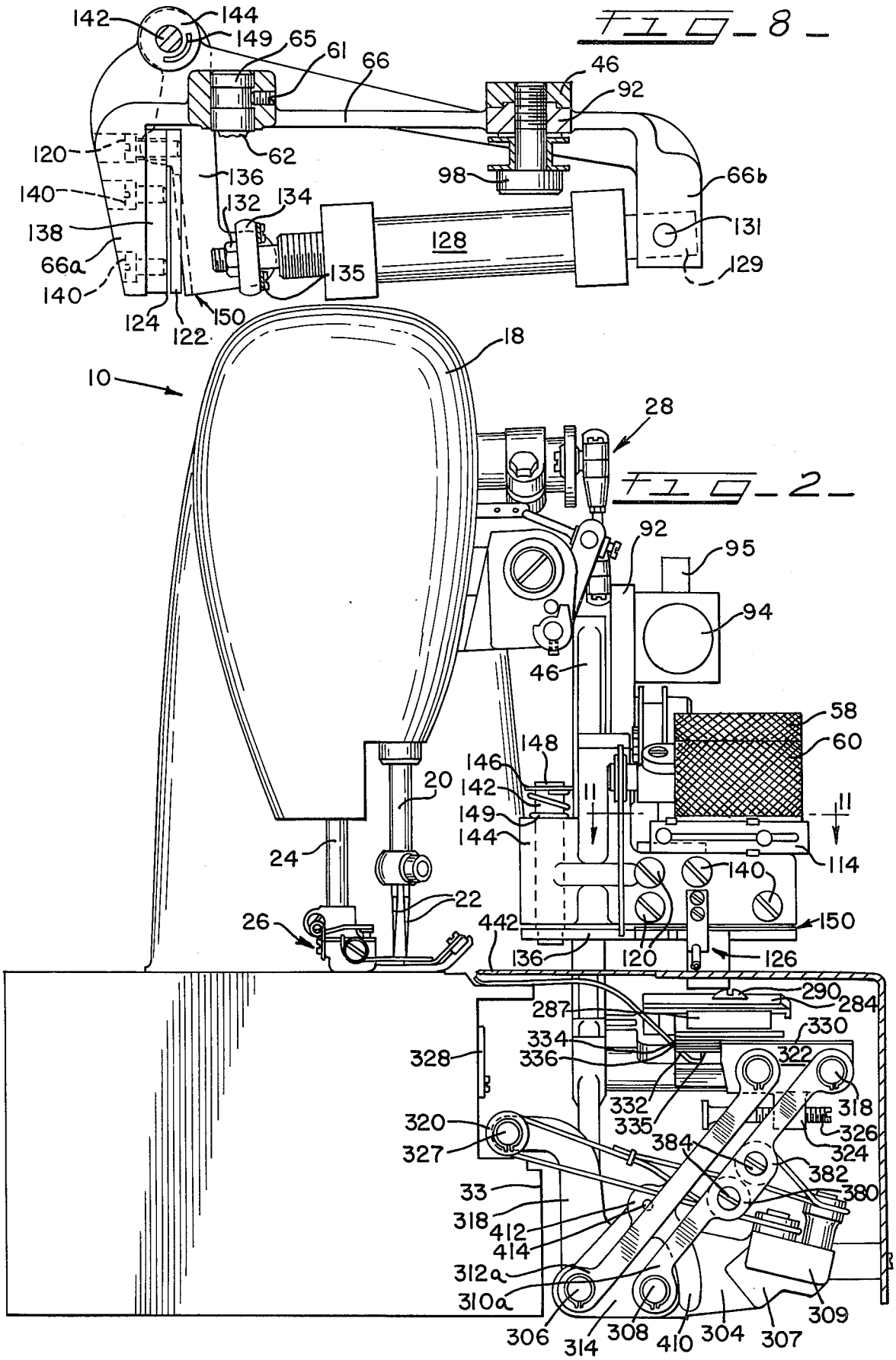
FIG. 2 is an end elevational view of the sewing machine and the label inserter attachment.
FIG. 8 is a partial top plan view taken along line 8—8 of FIG. 1 showing the label cutter.

As is best shown in FIG. 1 the sewing machine generally indicated as 10 is comprised of a main hollow frame comprising a work supporting base 12, a vertical standard 14, and an overhanging arm 16, terminating in a needle head 18. Within the head there is mounted for vertical reciprocating, a needle bar 20 arranged to carry one or more needles 22 (FIG. 2). The number of needles provided will be determined by the character of the seam desired to be produced by the machine. There is also provided in the needle head 18 a presser bar 24 mounted for vertical reciprocation and arranged to carry the presser foot assembly means 26. There is provided on the overhanging arm 16 a metering device 28 which ensures the delivery of an accurately measured length of an elastic tape (not shown) to the work feeding devices of the sewing machine. Briefly stated, the metering device 28 is comprised of a feed roller 30 having a knurled surface, preferably of a diamond shaped configuration. Cooperating with the metering roller 30 is a smaller presser roller 32 which serves to hold the elastic tape against the roller 30 and grip it to prevent slippage. A pair of guide fingers 34 are provided for properly guiding the elastic tape to the bits of the rollers 30 and 32. For a more detailed description of the above described metering device reference is directed to the above mentioned patent.

Referring to FIGS. 1, 2, 3, 4 and 7, the label inserting attachment is spaced from, but yet secured to, the sewing machine base 33 by a support plate 33. A second support plate 46 is rigidly secured to the support plate 44 and serves as the main mounting base plate for the attachment. The mounting base plate 46 may be attached in any conventional manner to the support plate 44. As is viewed in FIGS. 4 and 7, the left side of the support plate 46 is further supported by a plurality of spacers 48 which are threadably engaged with the base casting 33. The support plate 46 is secured thereto in any conventional manner. When it is desired to add the attachment to a machine, it is simply necessary to take the attachment in one single piece and manually secure it to the machine in the above described manner.

A guide roller 50 is rotatably secured to the overhanging arm 16 and is provided to guide a continuous cloth ribbon or strip 52, from a supply roll 54 which is freely rotatably mounted upon a suitable support spindle 55 located above the mechanical unit. The ribbon 52 is unwound from the supply roll 54, passed around the roller 50, and guided toward a feeding and cutting unit generally shown as 56.

As is best shown in FIGS. 1, 2, 8, 9, 10 and 14, the feeder assembly means includes a pair of gripping feed rollers 58 and 60 which are suitably supported on shafts 62 and 64 respectively. Shaft 62 has its first end means 65 fixedly secured within a U shaped support bracket 66 by any suitable means such as 61. A feed roller drive sprocket 70 journals the longitudinal axis of the shaft 62. The drive sprocket 70 is rotatably mounted on the shaft by any suitable one way clutch means 72. Rotatably supporting the feed roller 58 on the drive sprocket 70 is a second set of one way clutch means 73 whereby setting up a one way driving connection between the sprocket 70 and the feed roller 58. The sprocket 70 is held from longitudinal movement by means 74 which is secured at the second end means 76 of shaft 62. The idler roller 60 is supported on a shaft 64 which is secured at its first end means 80 within a rotatable roller arm 82. The arm 82 is pivoted about a stud 84 whereby the idler roller 60 is rotatably shiftable about the pivot pin 84. The roller means 60 is urged into gripping relationship with the roll 58 by a spring means 86 in order to keep the ribbon 52 substantially flat and smooth. The spring means 86 is connected at its first end means 87 to a projection means 81 on the arm 82 and is held at its second end means 88 by a pin 90 secured in the wall of support 66.

The support means 66 has an upwardly extending arm 92 to which a double acting expansible and retractable air cylinder piston unit 94 is fixedly secured by any suitable means such as 96. The support means 66 is vertically adjustably secured to the support plate 46 by a screw means 98 for reasons discussed hereinafter. A centrally disposed vertical slot means 100 is provided in the extending arm means 92 such that the entire feeding and cutting assembly 56 is adjustable in either vertical direction. The pneumatic air cylinder 94 couples with spring means 112 to forcibly drive the feed roll means 58 whereby advancing a label. The pneumatic cylinder means 94 is normally held in its extended position as shown in FIG. 1. A switch means 95 is secured to cylinder means 94 for reason discussed hereinafter. A chain means 106 is coupled at its first end means 99 to a bracket means 102 secured to the driving end of pneumatic cylinder means 94. The second end means 110 of chain 106 is coupled to the spring means 12. Chain means 106 partially wraps around and is meshed with a sprocket gear 108 which is formed as an integral part of the sprocket means 70. Once the air from the cylinder means 94 is released into the atmosphere, as will be described hereinafter, the spring means 112 forceably drives the chain means 106, thus rotating the toothed gear 108. Because of the rotation of the gear 108 the drive sprocket 70 is caused to rotate whereby forcibly rotating the feed roller 58 due to the clutch means 73. Actuation of the feed roller 58 feeds the ribbon 52 between the roller 58 and the spring biased roller 60. The idler roll 60 is unpowered. The return of the chain 106 to the extended position shown in FIG. 1 is achieved by supplying air under pressure to cylinder means 94. Actuation of the expansible air cylinder 94 as well as all the other pneumatic components of the assembly is controlled through the action of the pneumatic control circuit illustrated in FIG. 16 and whose operation will be described below.

As is best shown in FIGS. 1 and 11, once the ribbon has passed through the rollers 58 and 60, in a substantially flat and smooth state, it enters a guide tube assembly means 114. A bracket means 122 is employed to position the guide tube assembly 114 immediately below the feed rollers 58 and 60. The guide tube is provided with two sets of guides 116 and 118 which are adjustable by any suitable means in a horizontal plane to allow the use of labels in various widths. The inner edge guide 118 governs how far the leading edge of the label will be presented to the feed dog. The other edge guide 116 is to allow for various widths of labels. The use of these guides in combination with the folder and transporter, which will hereinafter be described, allow the label to be delivered accurately each time to the sewing area.

As viewed in FIG. 8, a plurality of screw means 120 are employed to hold the bracket means 122 onto the bracket assembly's left arm means 66*a*. The bracket means 122 is provided with a gap 124 which serves to guide the ribbon to the cutter assembly. As is best viewed in FIG. 14, the ribbon 52 is provided at spaced intervals with notches such as 120 which define the length of the label. As the label advances through the passageway 124 a sensor 126, (FIG. 1) which is the first in a series of pneumatic sensors, detects the presence of the hole or notch 120 in the ribbon 52 and signals the pneumatic circuitry causing the feed roller to stop and setting up conditions that allow the remaining tasks of cutting, folding and advancing of the label to take place. As discussed earlier, there is a switch 95 mounted atop the pneumatic cylinder means. The purpose of the switch 95 is to supply the air sensor means 126 with air at the proper time, that is, air is supplied to the air sensor 126 when the label strip is advanced by the rollers 58 and 60. The switch means 95 senses the movement of the driving end of the cylinder 94 and activates the air flow to the sensor 126. If it were desired to utilize an electrical circuit, one might employ a series of photosensitive detectors in lieu of pneumatic sensors shown in the preferred embodiment, for sensing detectable areas on the tape means 52.

After the correct position of the label ribbon has been sensed by the sensor means 126 the control circuitry energizes a double acting expansible and retractable pneumatic cylinder means 128 which forms part of the cutter assembly. The first end means 129 of force transfer means 128 is held rotatably stationary by a pin means 131 securely held in the right arm means 66*b* of support 66. The second end means 132 of the pneumatic cylinder 128 is secured to a T shaped bracket means 134. Secured as by any suitable fasteners to the upper end of the T shaped bracket means is a brake assembly means 135. The brake assembly means 135 applies a braking force to the feed roller 62 while the pneumatic cylinder means 120 is held in its normally extended position as shown in FIG. 1. This braking force prevents any vibrational rotational movement of the feed roller 58 in the feed advancing direction while the pneumatic cylinder is extended whereby preventing further advancement of the strip 52. The lower end of the T shaped bracket 134 is secured to a movable knife 136. The movable knife 136 cooperates with a stationary knife 138 which is secured to the bracket means 66 by means of any suitable fasteners such as 140. The movable knife 136 is pivoted about a roll pin 142 which is journaled within a struck up member means 144 located on the bracket assembly 66. A ring type device 146 is secured to the upper end 148 of the roll pin 142. A spring means 149 is disposed between the ring type device 146 and the struck up member 144 such that the movable blade 136 is held in a cutting relationship with the fixed blade 138 in a well known manner.

Located beneath the feeder and cutter assembly 156 are a series of elongated guide assembly means 152 and 154. These guide members 152 and 154 are in a somewhat similar horizontal plane as the base 12. As viewed in FIG. 1, the guide member 154 has an anvil 155 secured to its right bottom side. As previously discussed, the label is fed between the feed rolls 58 and 60 down through the guide member 114 passing through the slot 124 and continues downwardly into the area generally marked as 157 until the pneumatic control circuit senses the notch 120 in the ribbon 52. The control circuit then interrupts the driving force delivered to the drive sprocket 108. Almost simultaneously timed with the sensing of the notch 120, the pneumatic circuitry actuates a clamp means 160 which acts in conjunction with the feeder and cutter assembly 156 enabling a predetermined length of label to be cut from the supply roll and clamped at its bottom most end against the anvil 155 by the clamp assembly means 160. The distance between the knife assembly 156 and the clamping mechanism means 160 may vary with different applications, but yet this distance must be strictly controlled. The strict control is necessitated by the requirement that the label be folded exactly in the middle. For this reason, the adjustable feature, namely the vertical slot means 100 discussed above is provided, whereby insuring accuracy in positioning the cutter assembly relative the inserter band as well as lending the insertion devices to varied applications.

As is best seen in FIGS. 1, 3 and 7 the clamping member 160 is pivoted about the point 162. This is made possible by a stud 164 being mounted within the support means 46 and the clamp member 160 being pivoted thereabout. At its lower end means 166, the clamp means 160 is connected to a clevis type rod which is further connected to a pneumatic expansible and retractable cylinder 170 which is provided to forcibly drive the clamping member 160 into a clamping relationship with the anvil 155. At its upper end means 163 the clamp means 160 is provided with a roller means 165 which is rotatably fixed thereto. The roller means 165 clamps the strip against the anvil 155. As will be further described hereinafter, when the inserter band advances to fold the label, said label will be easily removed from the clamping arrangement due to the motion of the roller 165 whereby allowing removal of the label for further advancement by the inserter band 174.

As may be best seen in FIGS. 1, 4 and 6, the horizontally disposed guide member 152 has a central slot 172 which extends horizontally to accommodate a flat elongated label pushing and folding band 174. The horizontally disposed guide member 152 includes an upper guide member 176 and a lower guide member 178. The upper guide member 176 is fixedly secured to the support means 46 by any suitable fasteners such as 179. The lower guide member 178 is fixedly secured to the upper guide means 176 by means 180. The top guide means 16 is provided with an oil slot 182 which is provided in the guide member 176 for purposes of lubrication o the slidable band 174. Oil cups 184 and 186 are employed for supplying the oil to the recess 182. A second air sensor 190 is provided within the guide member 152 to sense the presence or lack of presence of the inserter band 174 with respect thereto. An air line 564 supplies air to the air sensor 190 while the second air line 567 works in conjunction therewith, in a well known manner.

One of many unique aspects associated with this device is the fact that it is quite compact. In order to save space requirements the inserter band 174 has been partially wound about the periphery of a drum assembly means 210 whereby an extended degree of travel of the band 174 is obtainable. As seen in FIGS. 6 and 13, the band 174 is provided with an elongated slot means 234. The purpose of the slot 234 is to allow free passage of air through the air sensor 190 whereby allowing close access of the band to the folding area, indicated earlier as 157. The upper guide assembly 152 cooperates with a lower guide assembly 212 to effectively guide the band in the correct manner along a predetermined path of movement. The lower guide assembly 212 is constructed in much the same manner as the upper set of guides 152, that is, there is an upper guide member 214 secured and carried by the support bracket 46 and a lower guide member 216 which is fixedly carried by the upper guide 214. The lower guide assembly 212 has a central slot 218 which is defined by the horizontal aperture between the upper guide 214 and the lower guide 216. This central slot 218 extends longitudinally of the lower guide assembly to accommodate the inserter band 174. The band means 174 is carrried or guided by the lower slot 218 and the upper slot 172 during the operation of the apparatus. Both the lower slot 218 and the upper slot 172 are provided with only the necessary clearance around the band, so that the band will be maintained flat and smooth. That portion of the blade 174 traveling the periphery of the drum 228 is substantially enclosed and protected by a shield 220. There is provided in the shield 220 a recess 234 (FIG. 7) which allows free passage of a plurality of projecting studs 230 located on the periphery of the drum and the band 174.

In a review of FIGS. 1 and 7 it may be seen how the band is transported and forcibly driven by the drum assembly 210. The drum assembly is rotatably mounted about a stud 222 which is fixedly secured with the support 46 by any suitable means such as 224. Journaling the long axis of the stud 222 is a sprocket assembly means 226. A drum means 228 is mounted on the sprocket assembly 226 and is fixedly secured thereto for rotational movement therewith. As mentioned above; the drum 228 hs a plurality of studs 230 formed about the periphery thereof. These studs 230 cooperate in a driving manner with the expandable band 174, and more particularly those studs 230 associate with the hols 232 (FIG. 13) in the band 174. The sprocket assembly 226, and the drum 228 mounted thereon, are forcibly rotatably driven when a double acting expansible and retractable pneumatic cylinder 240 is activated. The pneumatic cylinder 240 is secured to the main frame assembly 46 by any suitable means such as 242. The driving end 244 of the pneumatic cylinder 240 is coupled to a chain 246 by a suitable coupling such as 248. The coupling 248 is fixedly held to the driving end 244 of the pneumatic cylinder 240 by a plurality of pins generally indicated as 247, although any suitable fasteners would be appropriate. As viewed in FIG. 5, the lower end 250 of the coupling 248 is fixedly attached to the chain 246 by a plurality of pins 252. The endless chain 246 in turn meshes with the sprocket 238 and is wrapped around an eccentrically mounted idler roller 254. Thus, when the pneumatic cylinder 240 is energized it causes the sprocket 238 to rotate, thereby rotating the drum assembly 210, forcibly advancing the band 174 to the left as shown in FIG. 1. As mentioned above, the pneumatic cylinder means 240 is double acting, such that once the label has been advanced into position the drum and band are positively returned to their initial state by the reverse action of the force transfer means 240. An adjustment screw 260 is provided at the end 262 of the pneumatic cylinder 240 to control the length of the stroke of the cylinder 240. In this manner, when the length of the label varies an adjustment is possible for the effective travel length of the band 174.

As may be best viewed in FIGS. 1 and 4, the second upper guide assembly means 154 includes upper and lower plate members 270 and 272 respectively. The lower guide member 272 has two depending lugs 274 and 276 which serve to fixedly secure the lower member 272 to the main plate 46 by any suitable fastener means such as 278. Each of the guide members 270 and 272 have a flat surface means 280 and 282 respectively, which are in an abutting relationship. This abutting relationship is made possible by a support member 284 which is secured to the lower member 272 by a plurality of fasteners such as 286. Between the support member 284 and the upper surface 285 of the guide member 270 is an elongated leaf spring type means 288. The center portion of the spring means 288 is supported by the bracket means 284 while its end means 287 and 289 apply a downwardly directed force against the member 270. In this manner the upper guide member 270 is spring loaded against the lower guide member 272 whereby a yielding effect, giving way for passage of band 174, is made possible. The point at which the flat surface means abut defines a label feed path. When the inserter band 174 advances from its initial or home position shown in FIG. 1, it meets the cut label, vertically disposed and clamped in the area 157, thus folding it in half and advancing it through the label feed path. As viewed in FIG. 1, the right end side of the upper and lower guide members 270 and 272 is chamfered as shown at 292 whereby aiding in folding the cut label.

It should be pointed out, that the edge of the label which is presented under the presser foot must be strictly controlled. The label as sewn into a seam must be straight with respect thereto, that is, the label cannot have its major plane at an angle to the major plane of the fabric. For the above stated reasons an abutting system as has been previously described is employed to exert uniform pressure on the label as it is folded and fed down the label feed path. The leading edge 192 of band 174 is exactly parallel to the feed path of the fabric whereby if the label is not evenly displaced along said edge the uniform friction applied by the spring loaded plate means 270 and 272 along with the lateral motion of the band 174 aligns the label against the leading edge 192 of the band to insure accurate positioning and delivery of the label to transporter assembly 200. Once the label has been delivered to the transporter assembly the band means 174 is forcibly returned, leaving the folded label accurately positioned within the transporter assembly means 200.

The label is now disposed within the transporter assembly means 200, ready for deliverance into close proximity with the sewing area. The transporter assembly means 200, while in its retracted position, is positioned in line with the discharge end 300 of the guide assembly 154, both of which are remote from the sewing area. As may be best viewed in FIGS. 1 through 5, the transporter assembly includes a bracket assembly 304 which is fixedly secured to the main support bracket 46 by any suitable fasteners such as 302. Fixedly secured in the base member 304 are pivot studs 306 and 308. Struts 310 and 312 are pivoted for rotational movement at their first end means 311 and 313 about the pivot studs 306 and 308. Also pivotally mounted, but spaced from the strut means 310 and 312, is a second series of struts 310*a* and 312*a* which are also pivoted about the stud means 306 and 308. The struts 310, 312, 310*a* and 312*a* pivotally carry at their second end means 315, 317, 315*a* and 317*a* respectively, a leaf base means 322. The leaf base 322 has formed as an integral part thereon a depending extension 324. Threadably engaged with the extension 324 is an adjustable stop screw means 326 which cooperates with the stop plate 328 fixedly caried on the frame of the machine so as to limit the amount of movement of the transporter assembly. The leaf base 322 has fixedly secured thereon in a parallel relationship with the base 12, an upper blade 330 and a lower blade 332. The leaf base 322 is stepped so as to keep the two blades 330 and 332 in a spaced relationship. Spaced between the upper blade 330 and the lower blade 332 are two label gripping blades or jaws 334 and 336. These jaws frictionally engage the upper and lower sides of each label as the same is advanced into the transporter assembly by the inserter blade means 174. The jaws 334 and 336 serve to position and grasp the label from the band 174 as the band is returned to its initial position. Also carried between the blades 330 and 332, and in close proximity to the jaws 334 and 336 is another sensor or detector means 340. The purpose of the detector 340 is to sense the presence, or lack of presence, of the label positioned within the transporter assembly 200. The sensor includes a first air tube 342 and a second air tube 334 which associates at their first end means 346 and 348 respectively in the usual manner for sensing an article placed therebetween. The lower plate 332 is provided as at 350 with a cutout providing the necessary room for connecting the second end means 352 and 354 of the air tubes 342 and 344 with the air lines 520 and 522.

As viewed in FIGS. 2 and 3, the right end 307 of the support 304 is provided with a projection 309. The projection 309 serves as the base for two pulleys, namely 321 and 323 which are rotatably supported on two studs 314 and 316. At the left end, the support 304 is provided with an upwardly extending arm 318. At the extreme left end, the arm 318 is provided with a pulley 320 which is rotatably mounted on a stud 327 which is fixedly held in the arm 318. Between the spaced struts 310, 310*a* and 312, 312*a* are positioned two tie sleeves 380 and 382. These two sleeves are rotatably held to said struts by a plurality of fasteners such a 384. A force transfer means 390 which includes a pneumatic cylinder 390 and a cable 392 is employed for delivering the driving force to a transporter assembly 200. A bracket 395 is employed to fasten the expandable and retractable pneumatic cylinder 390 to the support base 46. The cable 392 has its first end 394 looped around the sleeve 380 and then proceeds to wrap partially around the pulley 320 and then extends towards the pulley 321. The cable 392 is then passed around the pulley 321 and has its second end means 396 fixedly held in the operable or movable end 398 of the pneumatic cylinder 390. A second cable 400 has formed at its first end means 402 a loop which surrounds the sleeve 382. The cable 400 then extends towards the operator and passes around the pulley 323. The cable 400 turns about the pulley 323 to connect at its second end means 404 to a spring 406 which has one end 408 fixed to a pin 410. The spring means 406 delivers the return force to the transporter assembly 200 at the desired time.

As the force transfer means 390 is retracted a driving force is delivered to the transporter assembly 200 through the cable 392 whereby advancing the transporter into close proximity with the sewing area. A unique feature of this device is the parallelogram type linkage which allows the plates 330 and 332 to transport the label beneath the workpiece and above the feed mechanism while maintaining a parallel relationship with the work support wherein the label is maintained in direct alignment, and in a parallel relationship with the edge of the workpiece.

As may be best seen in FIGS. 2, 3 and 7, there is provided a base sensor means 314 closely adjacent the strut means 312. The base sensor means houses yet another sensor or detector means 360 which associates with the strut 312 to sense the position of the transporter assembly. Approximately half way along the length of the strut 312 there is provided a curved arm 410 which cooperates with the sensor in a manner which will be described. There is also provided on the strut 312 opposite the arm 410 a projection 412 whih has located therein an aperture 414. When the transporter is in the load position as shown in FIG. 2, the aperture 414 is in line with the air passage 416 located in the base assembly 314. Air is provided to the air passage 416 by an air line 532. In this manner, when the transporter is in the position as shown in FIG. 2 air freely passes through the passage 416 and through the aperture 414 into an air conduit 536 whereby signaling the control circuitry that the transporter assembly 200 is in the load position. Once the pneumatic cylinder 390 is activated the struts rotate about their pivot points. As air continues to pass into the passage 416 its continued flow is blocked by the arm 410 which is in close proximity with the discharge end 420 of the sensor whereby blocking the passage of air, thus signaling the circuitry that the transporter is no longer in the load position. It should be noted that the arm 410 extends outwardly a sufficient amount to cover the sensor means 366 the entire time the transporter assembly is removed from the load position.

As was earlier discussed, the transporter assembly carrying the label is continually forcibly driven in a parallel relationship with the base, until the stop means 326 engages with the stop plate 328. The top and bottom plates 330 and 332 respectively have a cutout portion means 430 thereon. The cutout portion enables the transporter assembly 200 close access to the sewing area as shown in FIG. 3.

As may be best seen in FIG. 15, the label L is placed within the assembly 200 by the band means 174 such that the label extends outwardly from the transporter assembly and beyond the cutout 430. As previously discussed, the amount of label extending outwardly of the transporter assembly 200 is governed by the guide means 118 (FIG. 11). To help insure a proper deliverance of the label to the feed mechanism a spring plate means 434 is secured to one end 436 of the bottom guiding plate 272 (FIG. 1). This spring plate 434 supports that free end of the label extending beyond the transporter assembly during its movement to the sewing area. During its movement towards the sewing area the transporter assembly plates 330 and 332 come within close proximity with the throat plate 432. The adjustment of how close the plates 330 and 332 come to the throat plate is governed by the adjusting screw 326 relative the stop 328. The throat plate is provided on its top side with a cutout 338 to insure that the proper deliverance of the label, that is, on top of the feed and under the material, is made possible. The regular feeding motion of the feed dogs 440 grasp the label and remove it from the jaws 334 and 336 which hold the label in a secured position during the movement of the transporter from the load position into close proximity with the sewing area. An auxiliary support plate 442 serves to deliver the workpiece W above the transporter assembly 200 and above the feed. The auxiliary support plate may be supported in ay suitable manner. The workpiece W and the label L are fed together to the sewing area by the feed mechanism to be sewn. In this manner it is possible to produce a hem as shown in FIG. 12, that is, wherein the elastic E on top and then the workpiece, with the label being inserted and sewn to the underside of the hem. Because the label has been fed to the garment as described, there is no need to stop the sewing operation. That is, stoppage of the sewing operation is not called for to insert a label into the hem. Therefore, there is no time lost in the insertion of the label, resulting in greater productivity by the operator.

Once the label has been removed from the transporter assembly, by the fed dogs 440, the sensor 340 indictes the absence of the label to the control logic which then releases the air from the retractable and expansible cylinder 390 into the atmosphere. Once the pressure from the cylinder 390 is released into the atmosphere the spring means 406 forcibly returns the transporter assembly 200 to its original load position. This return force motion is transferred to the transporter through the cable 400 by the spring 406. As seen in FIGS. 1 through 5, and as was discussed earlier, the first end means 402 of cable 400 is looped around the sleeve 382. The cable 400 then passes around the roller 232 and is secured at its second end means 404 to the spring 406 which forcibly returns the transporter assembly to its original position. As best shown in FIGS. 1, 2 and 3 and as was discussed earlier, the end 436 of the guiding plate means has fastened thereto a spring plate 434. Also carried at the end 436 on top of the mounting end of spring plate 434 is a resilient rubber pad means 435. The resilient rubber pad means 435 contacts the bottom side means 335 of blade means 336 whereby dictating the extent of rearward and downward travel of the transporter assembly 200 and positions the same in its load position ready for insertion of another label.

Figure 16:
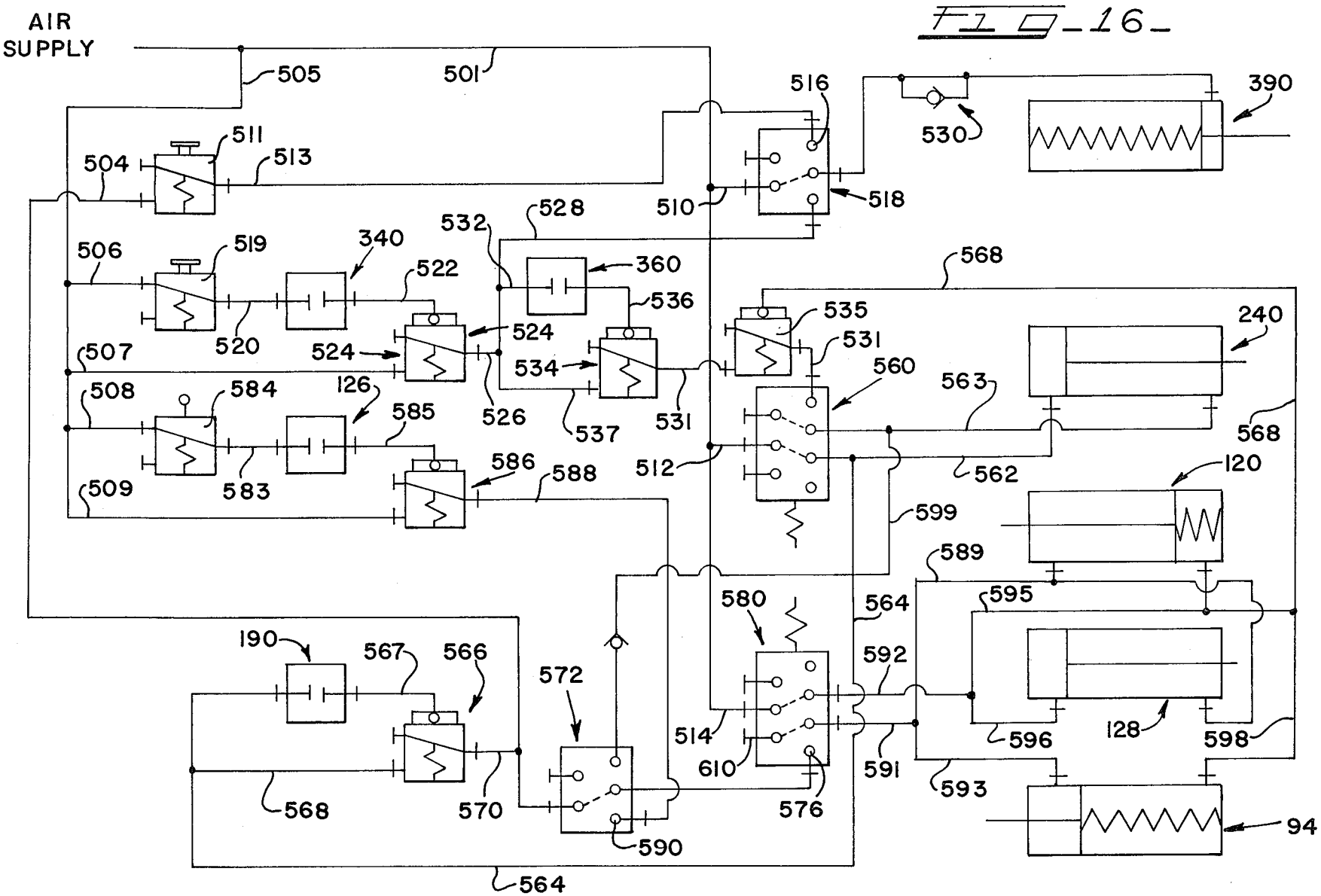

We will now proceed with the description of the operation of the pneumatic control circuitry illustrated in FIG. 16 which forms a schematic diagram of the pneumatic circuit in accordance with the present invention. Air is fed, under pressure, to the control system from a pressurized air supply source by the main air line means 501. This air is then fed into the conduit means 505 and is presented to the air line means 506, 507, 508 and 509 respectively. Air is likewise presented to the air line means 510, 512 and 514 respectively, which are also connected to the main air line means 501.

Assuming that the transporter assembly has advanced a label above the feed dog but yet below the material and the label has been removed by the feed dog 440 and its associated parts, the following sequence occurs. Once the label has been removed from the transporter assembly, the sensor or detector means 340 senses the removal of the label and feeds air through the normally closed switch means 519. Air passes from the switch means 519 through the conduit means 520, the sensor 340 and through the conduit means 522 whereby shifting a normally open control valve means 524 to a closed position. This free flow of air was previously blocked by the presence of a label within the sensor. The now closed control valve means 524 delivers air through the conduit means 507, 526 and 528, thus delivering the air to the lower pilot means of valve body means 518. The presence of air to the lower pilot means of value body means 518 shifts the same whereby the air supplied to the valve body means 518 via the conduit 510 is disconnected. Air that was trapped within the cylinder means 390 is now able to escape into the atmosphere through check, valve means 530. The escapement of the air through the check valve 530 allows the transporter assembly means 200 to be forcibly returned to its load position through the forcible movement of the spring means 406. Air also passes from the control valve means 524 through the conduit means 526 and 532 to the sensor means 360 which senses the position of the transporter assembly 200. The sensor means 360 up until now has been blocked from the passage of air, by the arm means 410 associated with the strut 312 while the transporter assembly 200 was in its raised or second position. Now that the transporter assembly 200 has been forcibly returned to the load position, the air is allowed to pass through the detector means 360 and is presented to the control valve means 534 via conduit means 536. The presentation of air to the normally open control valve means 534 shifts the same and allows the passage of air from the control valve body means 534 to a valve body means 535 via conduit means 531. The valve body means 535 is normally held in an open position until such time as when the label ribbon is advanced, cut and clamped. The advancement, cutting and clamping of the label ribbon occurs immediately upon return of the inserter band to its initial or home position, that is, upon its return from positioning a label within the transporter assembly as will hereinafter be discussed. Once the label has been advanced, clamped and cut the valve body means 535 shifts to the closed position, whereby insuring that the label has been advanced into the position. Assuming that a label has been effectively advanced, clamped and cut from the supply roll and assuming that the valve body means 535 has been shifted to a closed position for reasons discussed hereinafter, thus, air is supplied to the upper pilot means of a spring return valve body means 560. Up until the time that air is presented to the upper pilot means of valve body means 560, the valve means 560 is normally held in such a state that it allows the free passage of air from the conduit means 512 to the conduit means 562 which delivers or supplies air to the double acting pneumatic cylinder means 240. The constant supply of air to the cylinder means 240 forcibly holds the band means 174 in the retracted or home position. The presence of air to the upper pilot means of valve body means 560 shifts the same whereby allowing the free passage of air from the conduit means 512 to the conduit means 563 which delivers or supplies air to the opposite end of the double acting pneumatic cylinder means 240. The air supply to the opposite end of the cylinder means 240 forcibly drives the transporter band to the left as viewed in FIG. 1. At the initiation of its movement the edge 192 on the transporter band 174 engages and folds the vertically upstanding clamped and cut label and the continued movement of the inserter band 174 advances the now folded label down the feed path and positions the same within the transporter assembly ready for deliverance into close proximity with the sewing area. The air which was present in the pneumatic cylinder means 240 is now exhausted through the conduit 563 which is now connected to the exhaust port on the valve body means 560.

Once the label has been advanced into position within the transporter assembly, the sensor means 340 no longer is able to pass air. Thus the control valve means 524 shifts to its original state due to the lack of air whereby removing the air from the valve body means 518, but the removal of air from the valve body means 518 does not shift the same. The cutoff of air from the control valve body means 524 also removes the air from the control vave body means 534 whereby removing the air passing through the control valve body 535 which therefore removes the pilot air presented to the valve body means 560. The spring return valve body means 560 shifts to its initial state, due to the lack of air, whereby disconnecting the supply of air through the conduit means 512 from the forward driving end of the transporter pneumatic cylinder means 240 and connects it to the opposite end whereby forcibly returning the band and the transporter to the position shown in FIG. 1. When the spring return valve means 560 is forcibly returned to the position shown in FIG. 16 air is supplied to the air line 564 via conduit 512 whereby shifting the valve means to the position shown in FIG. 16. The valve means 572 is removed from the position shown in FIG. 16 as will hereinafter be discussed. Now that a label has been accurately positioned within the transporter assembly 200 and the valve body means 560 has returned to its initial state, air is allowed to pass, via conduit means 564, to the sensor or detector means 190. While the pneumatic cylinder means 240 holds the band 174 in the retracted position, as was previously discussed, the slot means 234 in the band 174 dictates to the sensor means 190 that the band means 174 is being held in a retracted position. Thus air is allowed to pass through the detector means 190 and is delivered to a control valve means 566 via conduit means 567. The presence of air to the control valve means 566 switches the normally open control valve means into its closed position whereby air from the conduit means 564 is fed through the conduit line 568 through the control valve 566 and delivers the ar via conduit means 570 to a valve body means 572. Also connected to the conduit 570 is a normally open switch means 511 which is connected via conduit means 504. It should be noted that the switch means 511 is of any suitable type, that is, it may be a foot pedal switch or it may be a hand operated switch. When the operator desires to insert a label above the feed dog but below the material, she closes the switch means 511 whereby allowing the air to pass to the support upper pilot means 516 of valve body means 518 via conduit means 513. The presence of air to the upper pilot 516 valve 518 switches the valve body means 518 returning it to its normal operating state such that air is supplied to the transporter cylinder means 390 via conduit means 510 whereby forcibly retracting the operable end 248 of the force transfer means 390 so that the transporter assembly is raised above the feed but yet under the material, whereby delivering the label to the feeding assembly for insertion into a hem being formed. Also receiving air via conduit means 570 is a valve body means 572. The normally operating state of the valve body means 572 is such that it allows air to be passed from the conduit 570 to the lower pilot means 576 of valve body means 580 whereby shifting the same from the position shown in FIG. 16. By shifting the valve means 580 air is allowed to pass via conduit means 514 to conduit means 591. From the conduit means 591 air is supplied via conduit 589 to the clamp cylinder means 120 whereby opening the clamping assembly. Air is also supplied via conduit means 589 to cylinder means 128 whereby moving or opening the cutter blade 136.

Also connected to the conduit means 591 is a conduit means 593 which supplies air to the force transfer means 94 which aids the spring means 110 in relating the feed rollers. By supplying air to the cylinder means 94 and aided by spring means 110, the feed roller 60 is forcibly rotated whereby advancing the label. The label continues to advance until the notch 120 in the continuous ribbon 52 is sensed by the detector means 126. Once the notch 120 is sensed by the detector means 126, air is free to flow through the conduit means 508 through a normally closed switch means 584 and passes into a control valve means 586 via condiit means 583 and 585. The air presented to the control valve means 586 shifts the same whereby air is passed from the air lines means 509 through the now closed switch means 586 into the conduit means 588. The air from the control valve means 586 is presented to the lower pilot means 590 of valve body means 572 whereby switching the valve means 572. This switching action of the valve body means 572 disconnects air to the pilot means 576 of valve body means 580. The spring return associated with the valve body means 580 automatically shifts the valve body means 580 to its initial state whereby the air presented by the conduit means 514 is now connected to the air line means 592. Connected to the air line means 592 is the conduit means 595 which supplies air to forward end of the clamp cylinder means 120 whereby rotating the clamping assembly 160 about its pivot point 162 whereby clamping the label. Simultaneously therewith, the air in the conduit 592 is delivered via conduit means 596 to the rearward end of the knife cylinder means 128 whereby forcibly driving the movable knife 136 in a severing relationship with the stationary knife whereby severing the label from the ribbon. The forward motion of the cylinder means 120 also applies a braking force to the roller 60 via brake means 135 as was previously discussed. Also connected to the conduit means 592 via conduit 595 is the conduit means 568 which delivers air to the top of the control valve means 535 as was discussed earlier. In this manner, it may be insured that a label has been advanced into the folding area 157. Air is also delivered via conduit means 598 to the feed roller means 94 whereby returning the same to its initial extended state. Because of the one way clutch means associated with the feed roller 60, the feed roll 60 is not rotated. It should be noted that the valve body means 572 is returned to its initial state via air presented through the conduit means 599 to the upper pilot means of valve body means 572 when the valve body means 560 is returned to its original state. In this manner a label is prepared to be advanced into the transporter assembly once the operator delivers the label into close proximity with the sewing area, thus there is no loss of time.

OPERATION OF MACHINE

At the onset of the sewing operation, the fabric is placed beneath the presser foot, while the elastic strip, which is to be sewn to the top side of the fabric, is fed to the sewing area by the metering device previously described. The transporter assembly, having a label accurately positioned therein is in its first position, prepared to advance the label below the elastic and fabric for insertion into the hem. Once the fabric is placed beneath the presser foot, the sewing operation may commence.

Once the point is reached where it is desired to insert a label into the hem, the operator simply presses the switch means 511 while continuing with the sewing operation. The actuation of the switch causes the advancement of the label by the transporter into close proximity with the sewing area above the feed mechanism but yet below the fabric. As previously stated, the transporter moves the label toward the needle while maintaining the same in a plane which is parallel to the work support. The label is advanced to a point where the label is removed from the transporter assembly by the feed assembly which effectively advances the label, fabric and elastic to the needle whereby stitching the three together. It should also be appreciated that this device is also capable of temporarily attachinglabels into garments with presser sensitive adhesives.

A first sensor means placed within the transporter assembly senses the removal of the label from the transporter, and sets the logic of the pneumatic circuitry. The transporter assembly is then forcibly returned to its initial position, remote from the sewing area once the label has been removed therefrom. In its initial position the transporter assembly is ready for insertion of yet another label. A second sensor which associates with one arm of the transporter assembly, senses that the transporter has been returned. Upon sensing the initial position of the transporter, the pneumatic circuitry supplies air to the pneumatic cylinder which forcibly drives the inserter band from its home position whereby engaging and folding a previously cut and clamped label. The inserter band folds the label upon itself, and feeds it down the label feed path whereby any disorientation of the label with respect to the leading edge of the band is corrected by the spring loaded guide memebers which apply a frictional force to both sides of the label. This friction force positions the label on the leading edge of the band assuring the correct positioning of the label with respect to the fabric which is to be sewn. The elongated band continues to be forcibly driven until the label is accurately positioned within the transporter assembly. Once the first sensor, which detects the presence of the label in the transporter assembly, relates to the circuitry that a label has been positioned therein the pneumatic circuitry removes that supply of air from the driving end of the force transfer means associated with the elongated band and transfer the air supply to the retracting end whereby forcibly returning the band to its home position. As was previously discussed, the forcible return of the band to its home position is sensed by a third sensor which sets into action the associated mechanism for advancing, clamping and cutting the next label.

The label is now accurately positioned within the transporter assembly by the jaws which effectively hold the label during its advancement to the feeding mechanism. The label is now ready for deliverance into close proximity with the sewing area whereby the label will be advanced and positioned above the feed mechanism and below the fabric. It should again be pointed out that the transporter moves the label to the sewing area keeping a parallel relationship with the base of the machine whereby insuring accurate positioning of the label to the underside of the garment to be sewn.

From the foregoing description it should be readily appreciated that the above described label inserting assembly is an effective device for feeding preselected lengths of labels to the underside of the fabric to be sewn and thereby provide a hem which has an elastic band positioned on top of the fabric and the label on the underside thereof. The above described hem being used on a wide variety of products, a noteworthy and exemplary one of which is men's briefs, discussed earlier.

Thus, it is apparent that there has been provided, in accordance with the invention, a sewing machine attachment that fully satisfies the objects, aims, and advantages set forth above,. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

What is claimed:

1. Apparatus for feeding labels to a sewing machine, said machine including a work support, feed advancing means, and a stitch forming means, and said apparatus comprising:

label storage means;

means for feeding and cutting predetermined lengths of labels from said label storage means;

means for engaging and folding the label upon itself;

means for orientating and advancing the folded label from an area remote from said stitch forming means to a delivery point; and transporting means for advancing said folded label from said delivery point under said fabric for presentation to said feed advancing means whereby gripping said folded label from said transporting means and feeding the same to said stitch forming area where it is attached to a garment being sewn.

2. Apparatus according to claim 1 wherein:

said transporter means moves in a path substantially perpendicular to the path of movement of said advancing means.

3. An apparatus according to claim 1 further comprising:

a first device for actuating said cutting means;

a second device for actuating said feed means;

a third device for forcibly moving said advancing means;

a fourth device for forcibly moving said transporter means about a pivot point; and control circuitry means for controlling the actuation of said first, second, third and fourth devices.

4. In combination, a sewing machine including a work support, a sewing needle and feed advancing means defining a sewing station, and a label inserter for inserting a label to the underside of said fabric piece, said label inserter comprising:

a supply roll of ribbon;

means for feeding, cutting and clamping said ribbon into preselected lengths;

means defining a label feed path orientated substantially parallel to said work support;

label engaging and folding means operable to forcibly urge said label along said path whereby locating the folded edge of said label into a first position;

transporter means for receiving said label at said first position; and means for forcibly moving said transporter means through a feed stroke into close proximity with said sewing station.

5. Apparatus as in claim 4, further comprising:

means withdrawing said transporter means to said first position.

6. A label inserter for sewing machine as claimed in claim 4 wherein said label engaging and folding means operable to urge said label along said path comprises:

an elongated band means operatively effective to travel along said label path;

a drum assembly means having an engaged relationship with said band means; and force transfer means for driving said drum whereby forcibly moving said band along said label path.

7. A label inserter for a sewing machine as claimed in claim 4 wherein said means defining a label feed path comprises:

a plurality of elongated member means having at least one flat surface means, said flat surface means being in an abutting sliding relationship with said label engaging means wherein movement therebetween is possible.

8. The label inserter of claim 7 wherein:

said elongated member means includes;

first and second elongated means having at least one flat surface means, said flat surface means being in an abutting relationship with each other, said first elongated means being spring loaded against said second elongated means.

9. The label inserter means of claim 4 wherein said transporter means comprises:

base support means;

a plurality of strut means having first and second end means, said strut means being pivotally secured to said base support means at said first end means for movement towards and away from said sewing area;

leaf base means pivotally carried on said strut means second end means;

two or more spaced blade means fixedly carried by said leaf base; and means for holding said label in position as said transporter means is forcibly moved through a feed stroke.

10. A sewing machine attachment for use in combination with a sewing machine having a work surface for supporting a workpiece, a sewing needle, and feed advancing means defining a sewing area, said attachment comprising:

label storage means;

means for feeding, cutting, and clamping a predetermined length of label from said label storage means;

label engaging and folding means;

means for advancing and orientating the folded label from a first position remote from said sewing area to a second deliverance position;

transporter means for receiving said folded label at said deliverance position;

means for moving said transporter means toward and away from said sewing area to deliver said folded label to said feed advancing means;

means for initiating the moving means to advance the transporter assembly means into close proximity with said sewing area;

first sensor means for determining the presence of said folded label in said transporter assembly;

second sensor means for determining whether said transporter assembly is in said deliverance position; and control means responsive to said initiating means for controlling said feeding, cutting and clamping means and preventing movement of said label engaging and folding means when said second sensor means determines that said transporter assembly is not in said deliverance position.

11. The sewing machine attachment of claim 10 wherein said label engaging and folding means comprises:

an inserter band means having an edge means for engaging a label, said edge means extending parallel to the feed path of said workpiece; and a plurality of horizontally extending guide members which are in an abutting guiding relationship with said elongated band means whereby a sliding relationship therebetween is possible.

12. The sewing machine attachment of claim 10 further comprising:

means for adjusting the relative deliverance position of said transporter assembly means.

13. The sewing machine attachment of claim 11 wherein said horizontally extending guide members include:

first and second elongated means having at least one flat surface means, said flat surface means being in an abutting relationship with each other.

14. The sewing machine attachment of claim 13 further comprising:

a bracket means rigidly carried by said second elongated means; and a leaf spring means having a center portion means and first and second end means, said center portion means being supported by said bracket means, and said first and second end means contacting and driving said first elongated means into an abutting relationship with said second elongated means.

15. The sewing machine attachment of claim 10 wherein said means for feeding, cutting and clamping a predetermined length of label from said label storage means comprises:

feed roll means engaging a label strip from said label storage means and removing the same therefrom;

first and second label tape guiding means, said first label tape guiding means including a series of spaced apart means operative to engage one edge of said label strip whereby it is aligned for subsequent positioning in said transporter means;

said second label tape guiding means including a series of spaced apart means operative to engage second edge of said label strip, said first and second label tape guiding means being adjustable in a plane perpendicular to the major plane of the label tape;

a cutting means to sever said strip respective to a detectable area thereon and thereby form individual labels; and a clamping means for clamping the free end of the label strip responsive to said detectable area on said strip.

16. The sewing machine attachment of claim 15 wherein said first guiding means guides said label strip in a plane generally perpendicular to the major plane means of said elongated band means and is laterally adjustable relative thereto.

17. A sewing machine attachment for use in combination with a sewing machine having a work support for supporting a workpiece, means for supplying an elastic tape to the top side of said workpiece, feed advancing means and stitch forming means when combined form a sewing area, said attachment comprising:

means for storing a label strip having detectable areas thereon;

feed roll means engaging said strip and feeding the same to a severance means;

first sensor means for detecting said detactable area determining whether said strip is in position for cutting by a severance means;

severance means for severing said strip into preselected lengths;

means to fold the label upon itself;

second sensor means for sensing the position of said folding means;

means for advancing and orientating the folded label between a plurality of elongated guide members to a delivery point;

transporter means for delivering the label to the underside to the workpiece from said delivery point remote from said sewing area to an area closely adjacent the sewing area;

third sensor means carried by said transporter means for sensing the presence of a folded label within the transporter;

driving means for moving the transporter into close proximity with the sewing area whereby the feed advancing means may remove said folded label and advance the same into the sewing area;

fourth sensor means for determining the position of said transporter means; and pneumatic circuitry means responsive to said third sensor means for controlling the feeding, clamping and cutting of said label strip when said label is absent from said transporter assembly as well as to initiate the insertion of a folded label under the workpiece under the control of the operator.

18. A sewing machine attachment of claim 17 wherein said sensors are pneumatically operated.

19. A sewing machine attachment of claim 17 further comprising:

clamping means for clamping each separated label whereby maintaining said label in a vertically standing position.

20. A sewing machine attachment of claim 17 wherein said folding means folds said label substantially at the longitudinal center of said label.

21. A sewing machine attachment according to claim 15 wherein said label tape guiding means is carried between said feed roll means and said cutting means.

22. A sewing machine attachment according to claim 17 wherein said means for driving the transporter comprises:

an expansible and retractable device which includes a plunger mounted perpendicular to the path of movement of said transporter, and cable means connecting said expansible and retractable device to said transporter assembly whereby movement of said device affects movement of said transporter assembly.

23. A label inserter means for delivering a folded label means into close proximity with a sewing area of a sewing machine in a predetermined manner, said inserter means comprising:

a support means;

a folded label holding and carrying means spaced away from said support means; and a parallel bar linkage means connecting said holding and carrying means to said support means whereby the orientation of said folded label from pickup until delivery to said sewing area remains the same.

24. In combination, a sewing machine including a work support, a sewing needle and feed advancing means defining a sewing station, and an apparatus for deliverying labels to a point remote from said sewing station, said apparatus including label storage means, means for feeding, cutting and clamping preselected lengths of lable from said label storage means, means for folding said label upon itself at said label's longitudinal center, wherein the improvement comprises:

a plurality of horizontal elongated flat member means having at least one flat surface means therebetween in an abutting relationship; and said means for folding said label is adapted to extend between said elongated flat means whereby orientating and advancing said folded label to a point distant from said sewing station.

25. The label storage means of claim 24 wherein one of said elongated flat member means is spring biased against the remaining elongated flat member means.

* * * * *